US012599222B2

(12) United States Patent
Wang

(10) Patent No.: US 12,599,222 B2
(45) Date of Patent: Apr. 14, 2026

(54) ANTI-LOSS ROPE AND ANTI-LOSS DEVICE

(71) Applicant: GOOD NEWS MEDICAL CO., LTD., Keelung City (TW)

(72) Inventor: Tuan-Chung Wang, Keelung City (TW)

(73) Assignee: GOOD NEWS MEDICAL CO., LTD., Keelung City (TW)

( * ) Notice: Subject to any disclaimer, the term of this patent is extended or adjusted under 35 U.S.C. 154(b) by 37 days.

(21) Appl. No.: 18/746,574

(22) Filed: Jun. 18, 2024

(65) Prior Publication Data

US 2025/0213023 A1 Jul. 3, 2025

(30) Foreign Application Priority Data

Jan. 3, 2024 (CN) ..... 202410010082.1

(51) Int. Cl.
*A45F 3/14* (2006.01)
*A45F 5/00* (2006.01)

(52) U.S. Cl.
CPC ..... *A45F 3/14* (2013.01); *A45F 2003/142* (2013.01); *A45F 5/1508* (2025.01)

(58) Field of Classification Search
CPC ..... A45F 3/14; A45F 5/00; A45F 2200/0508; A45F 2200/0541; A45F 5/1508; A45F 5/1541
See application file for complete search history.

(56) References Cited

U.S. PATENT DOCUMENTS 6,707,924 B1 * 3/2004 Okiebisu ..... A45F 5/00 381/384
10,729,225 B1 * 8/2020 Kilpatrick ..... A45C 13/10
2008/0283651 A1 * 11/2008 Ito ..... H04R 1/1033 242/386
2009/0069060 A1 * 3/2009 Kim ..... H04M 1/6066 455/575.6
2014/0054346 A1 * 2/2014 Ledesma ..... A45F 5/00 224/576
2014/0185856 A1 * 7/2014 Koss, Jr. ..... A45F 5/00 381/384
2014/0242928 A1 * 8/2014 Kang ..... H02J 7/0044 455/90.3
2015/0225150 A1 * 8/2015 Farrell ..... H04R 1/1033 24/16 PB (Continued)

*Primary Examiner* — Brian D Nash
(74) *Attorney, Agent, or Firm* — Muncy, Geissler, Olds & Lowe, P.C.

(57) ABSTRACT

An anti-loss rope and an anti-loss device are disclosed. The anti-loss device includes a storage box, a pair of wireless in-ear audio devices stored in a storage box, and an anti-loss rope connected to the wireless in-ear audio devices. The anti-loss rope includes a rope assembly and at least one connecting mechanism. The rope assembly includes a joint part, a holding loop and at least one connecting section. The joint part is located between the holding loop and the connecting section, and the connecting mechanism is located on one end of the connecting section away from the joint part. The connecting mechanism is connected to a wireless in-ear audio device. The holding loop wraps around an outside of the storage box; because a holding loop is disposed on the anti-loss rope for wrapping around the outside of the storage box.

16 Claims, 19 Drawing Sheets

(56) References Cited

U.S. PATENT DOCUMENTS

| | | | | |
|---|---|---|---|---|
| 2016/0007723 | A1* | 1/2016 | Georges | A45F 5/00 224/580 |
| 2016/0095420 | A1* | 4/2016 | Moreau | F16B 45/00 248/317 |
| 2016/0198838 | A1* | 7/2016 | Abreu | A45C 11/00 224/183 |
| 2017/0078779 | A1* | 3/2017 | Hamparson | A44C 23/00 |
| 2017/0359452 | A1* | 12/2017 | Enojado | H04M 1/04 |
| 2018/0077479 | A1* | 3/2018 | Johanson | H04R 1/105 |
| 2018/0242064 | A1* | 8/2018 | Honeycutt | A45F 5/02 |
| 2018/0250168 | A1* | 9/2018 | Herring | H04R 1/1016 |
| 2019/0038009 | A1* | 2/2019 | Lim | H04R 1/105 |
| 2019/0208305 | A1* | 7/2019 | Santhuff | B65H 75/24 |
| 2021/0345742 | A1* | 11/2021 | Wright | A45C 13/02 |
| 2023/0396911 | A1* | 12/2023 | Cox | H04R 1/1016 |
| 2024/0365958 | A1* | 11/2024 | Wang | A45F 5/00 |

* cited by examiner

ANTI-LOSS ROPE AND ANTI-LOSS DEVICE

CROSS REFERENCE TO RELATED APPLICATIONS

This application claims priority of application No. 202410010082.1 filed in China on Jan. 3, 2024 under 35 U.S.C. § 119; the entire content is hereby incorporated by reference.

BACKGROUND OF THE INVENTION

1. Field of the Invention

The present invention relates to an anti-loss rope and an anti-loss device, and more particularly, it relates to an anti-loss rope and an anti-loss device for preventing a wireless in-ear audio device from being lost and for providing easy storage.

2. Description of the Related Art

Currently, the usage of wireless Bluetooth earphones among consumer groups is increasing; however, the components for connecting the wireless Bluetooth earphones to the human body consist only of earplugs, and the earplugs are connected to the human body by lodging them in the user's ear canals. It can be seen that this connection method is unstable, as slight force can easily dislodge the wireless Bluetooth earphones from the ears. During activities such as running, the wireless Bluetooth earphones are also prone to falling out of the ears. Considering this inherent defect of wireless Bluetooth earphones, it is not uncommon for them to be lost. Moreover, due to the higher cost of wireless Bluetooth earphones compared to traditional wired headphones, there is a need for an anti-loss device to prevent the loss of the wireless Bluetooth earphones. Currently, the most common anti-loss device on the market is the anti-loss rope. The anti-loss rope is usually sufficiently long for it to hang around the neck during use to ensure that there is enough slack to prevent the anti-loss rope from exerting a pulling force on the earphones. However, when not in use, the anti-loss rope is prone to tangling and knotting, leading to great inconvenience for the user. Therefore, it is necessary to design a new type of anti-loss rope and an anti-loss device to overcome the problems of the current art.

SUMMARY OF THE INVENTION

The object of the present invention is to provide an anti-loss rope and an anti-loss device via setting a holding loop on the anti-loss rope for being wrapped around the outside of storage box such that the anti-loss rope is easy to organize and store.

To achieve the abovementioned object, the present invention provides an anti-loss rope, and the anti-loss rope includes the following: a rope assembly and at least one connecting mechanism, wherein the rope assembly includes a joint part, a holding loop and at least one connecting section; the joint part is located between the holding loop and the connecting section; the connecting mechanism is located at an end of the connecting section away from the joint part; the connecting mechanism is used for connecting a wireless in-ear audio device; and the holding loop is used for wrapping around an outside of a storage box.

Furthermore, the rope assembly is an elastic rope, and the joint part makes the rope assembly form the holding loop and the connecting section.

Furthermore, the rope assembly includes an adjustment unit and a rope with two free ends. The adjustment unit includes a through hole, and the rope passes through the through hole at least two times, allowing the rope to loop around the adjustment unit for at least one coil. One loop forms the holding loop, and the rope cooperates with the adjustment unit to form the joint part at the adjustment unit; an amount of the at least one connecting section is two, and an amount of the at least one connecting mechanism is two. The rope includes two of the connecting sections, and each of the connecting sections is corresponded and configured with one of the connecting mechanisms.

Furthermore, the rope passes through the through hole three times, allowing the rope to loop around the adjustment unit twice, and the adjustment unit is tightened by another coil.

Furthermore, the rope is an elastic rope.

Furthermore, the connecting mechanism includes a first junction part, a second junction part and a holding ring which is connected to the first junction part and the second junction part. An inside of the holding ring forms a accommodating space. The first junction part and the second junction part are spaced apart to form an opening, and the opening links to the accommodating space. The first junction part includes a first hole, and the connecting section passes through the first hole and links to the second junction part. The opening is used for allowing the wireless in-ear audio device to pass through to be fastened to the accommodating space.

Furthermore, the second junction part includes a second hole. The connecting section passes through the second hole, and the connecting section is connected to the second junction part via a knotting method.

Furthermore, the connecting mechanism is a circlip, and the circlip is formed by bending a metal wire in one piece.

Furthermore, the connecting mechanism is a circlip, and the circlip is formed by bending a metal wire. The circlip includes a first arm and a second arm arranged relatively, a accommodating space located between the first arm and the second arm, a notch located on one side of the accommodating space and linked to the accommodating space, and a rope connecting part located on another side of the accommodating space. The notch is used for allowing the circlip to elastically deform when the circlip is connected to the wireless in-ear audio device. Each of the first arm and the second arm includes a guiding structure on two sides of the notch. The accommodating space is used for containing the wireless in-ear audio device, and the rope connecting part is connected to a free end of the connecting section.

The present invention also provides an anti-loss device. The anti-loss device includes: a storage box; a pair of wireless in-ear audio devices, and the wireless in-ear audio devices are stored in the storage box; an anti-loss rope, including a rope assembly and two connecting mechanisms, wherein the rope assembly includes a joint part, a holding loop and two connecting sections. The joint part is located between the holding loop and the connecting section, and the connecting mechanism is located at an end of the connecting section away from the joint part and connected to the wireless in-ear audio device. The connecting section wraps around an outside of the storage box, and the holding loop wraps around an outside of the storage box.

Furthermore, the rope assembly is an elastic rope, and the joint part makes the rope assembly form the holding loop and the connecting section.

Furthermore, the rope assembly includes an adjustment unit and a rope with two free ends. The adjustment unit includes a through hole. The rope passes through the through hole at least two times, allowing the rope to loop around the adjustment unit for at least one coil. One coil of the rope forms the holding loop, and the rope cooperates with the adjustment unit together to form the joint part at the adjustment unit. An amount of the at least one connecting section is two. The rope forms two of the connecting sections on two sides of the adjustment unit.

Furthermore, the rope passes through the through hole three times, allowing the rope to loop around the adjustment unit twice, and the adjustment unit is tightened by another coil.

Furthermore, the rope is an elastic rope.

Furthermore, the two connecting sections exposed outside the storage box are wrap around the same direction along the outside of the storage box. The holding loop wraps around the storage box in the same direction as the connecting section, or it wraps around the storage box perpendicularly to the connecting section and is sleeved on the storage box.

Furthermore, the wireless in-ear audio device includes a head, a rod and an ear cap which holds on the head and is stably connected to the head along a fastening direction. The head and the rod are connected integrally. The head includes an earpiece and a fastening slot surrounding the earpiece, and the ear cap includes a fastening convex part and a flexible ear cover connected to the fastening convex part. The fastening convex part is fastened to the fastening slot, allowing the ear cap to be fixed on the head. The flexible ear cover covers an outside of the fastening convex part, and the connecting mechanism wraps around the fastening convex part and is located between the flexible ear cover and the fastening convex part.

Furthermore, the connecting mechanism includes a first junction part, a second junction part and a holding ring connected to the first junction part and the second junction part. The holding ring forms a accommodating space inside. The first junction part and the second junction part are spaced to form an opening, and the opening links to the accommodating space. The first junction part includes a first hole, and the connecting section passes through the first hole and is connected to the second junction part. The opening is provided for the fastening convex part to pass through so as to be located in the accommodating space, allowing the holding ring to be located between the flexible ear cover and the fastening convex part.

Furthermore, the second junction part includes a second hole, the connecting section passes through the second hole, and the connecting section is connected to the second junction part via a knotting method.

Furthermore, the connecting mechanism is a circlip, and the circlip is formed by bending a metal wire in one piece.

Furthermore, the connecting mechanism is a circlip, and the circlip is formed by bending a metal wire. The circlip includes a first arm and a second arm arranged relatively, a accommodating space located between the first arm and the second arm, a notch located on one side of the accommodating space and linked to the accommodating space, and a rope connecting part located on another side of the accommodating space. The notch is used for allowing the circlip to elastically deform when the circlip is connected to the wireless in-ear audio device. Each of the first arm and the second arm includes a guiding structure on two sides of the notch. The accommodating space is used for containing the wireless in-ear audio device, and the rope connecting part is connected to a free end of the connecting section.

In comparison to existing technologies, the present invention offers the following beneficial effects:

Because a holding loop is set on the rope assembly for wrapping around the outside of a storage box, it is easy for the rope assembly to facilitate the organization and storage within the storage box. This helps prevent the rope assembly from becoming disorganized due to improper storage, thereby avoiding situations where the rope assembly becomes tangled.

DETAILED DESCRIPTION OF THE PREFERRED EMBODIMENT

In order to make it easier to understand the purpose, structure, features and effects of the present invention, the present invention will be further explained in conjunction with the accompanying drawings and specific implementation methods.

As shown in FIG. 1 to FIG. 4, for the anti-loss device in the specific embodiment of the present invention, the anti-loss device includes an anti-loss rope 100, a pair of wireless in-ear audio devices 200 and a storage box 300. The anti-loss rope 100 is used for connecting the wireless in-ear audio device 200, and the wireless in-ear audio device 200 is contained in the storage box 300. In the present invention, the wireless in-ear audio device 200 can be a wireless Bluetooth earphone, wireless hearing aids, or similar objects inserted into the user's ears and capable of emitting sound. In this embodiment, the pair of wireless in-ear audio devices 200 consist of two wireless headphones, and the storage box 300 is a charging case for the wireless in-ear audio devices 200.

Figure 1:
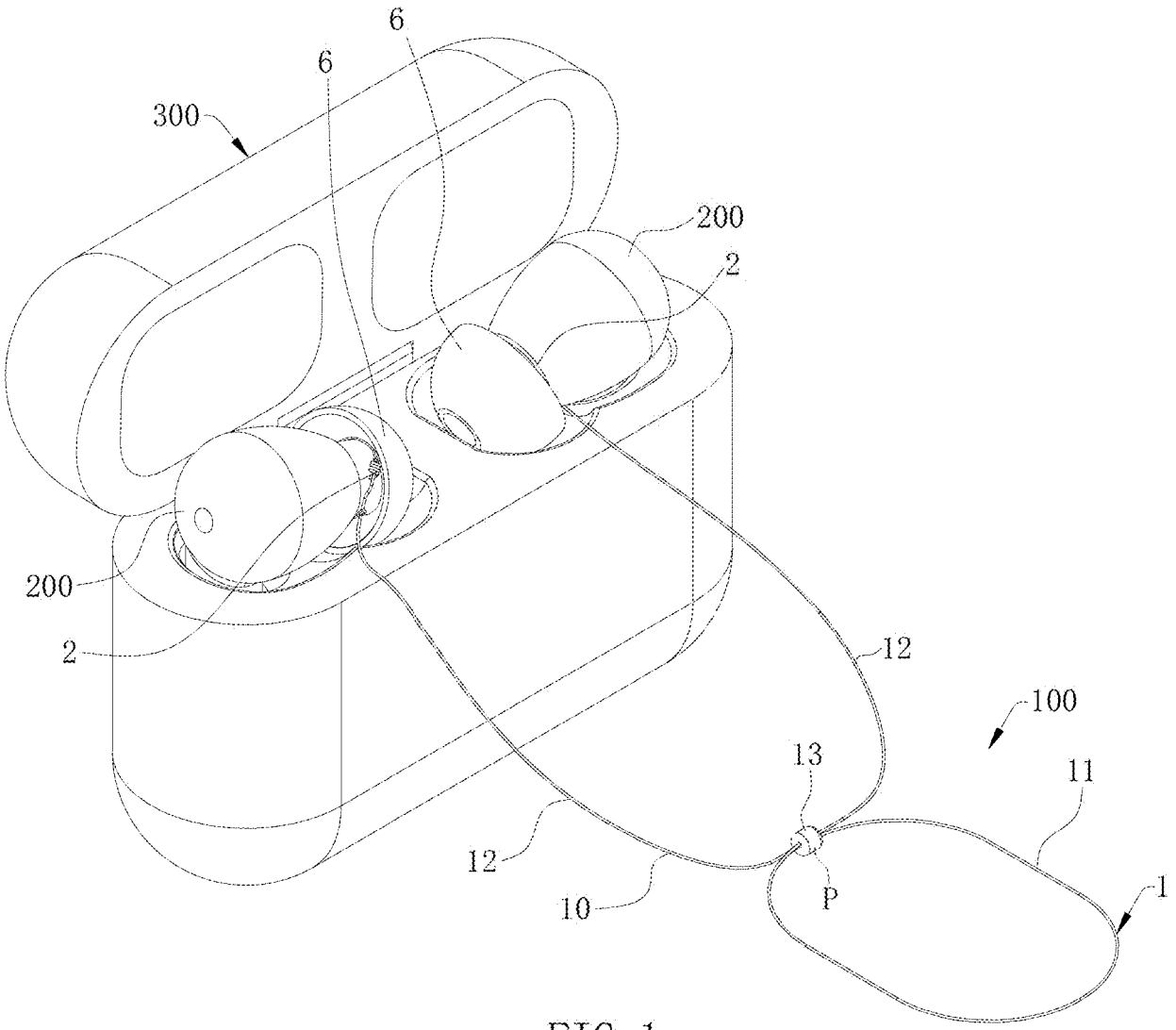
FIG. 1 is a perspective view of the anti-loss device of the present invention.
Figure 2:
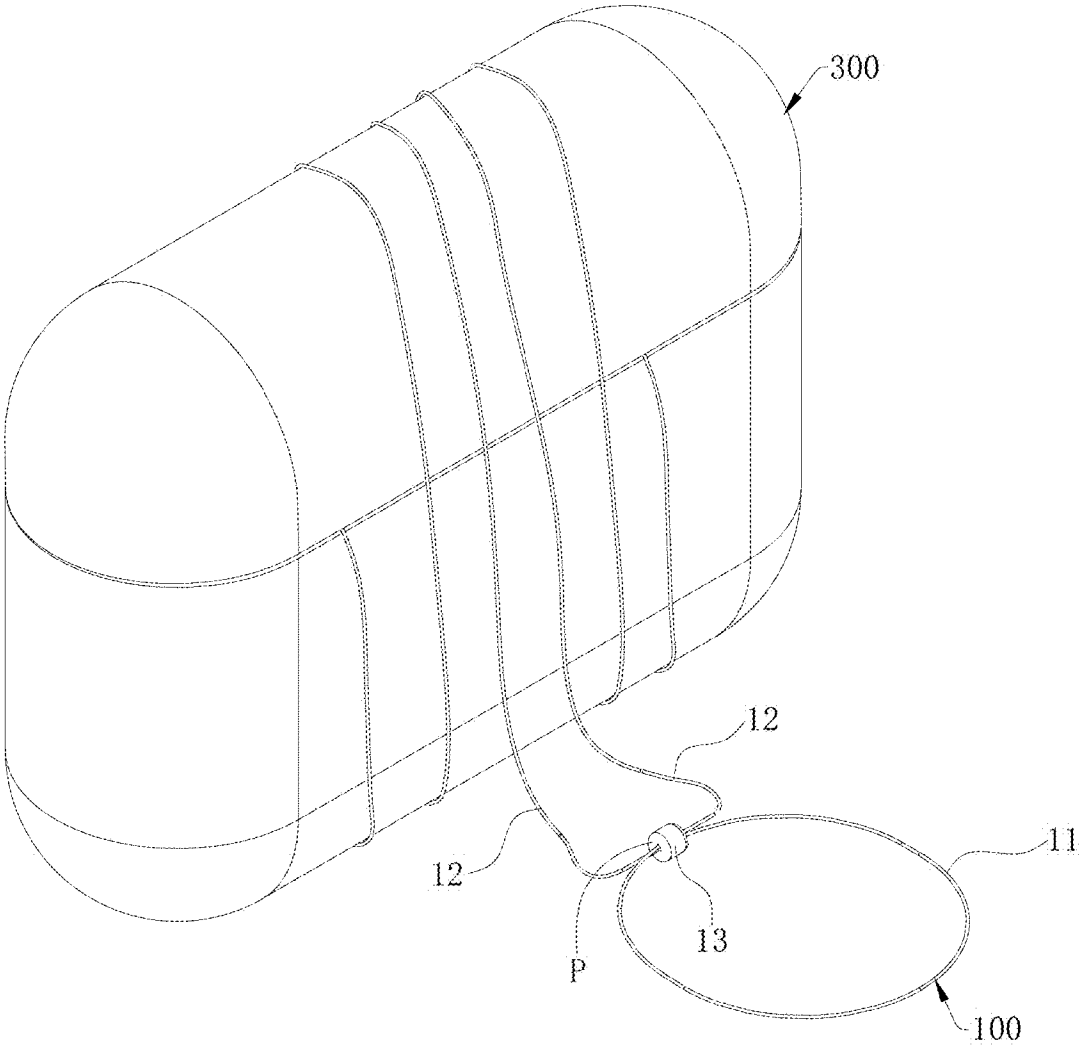
FIG. 2 is a perspective view of the anti-loss rope partially unrestrained in the storage box in the anti-loss device of FIG. 1.
Figure 3:
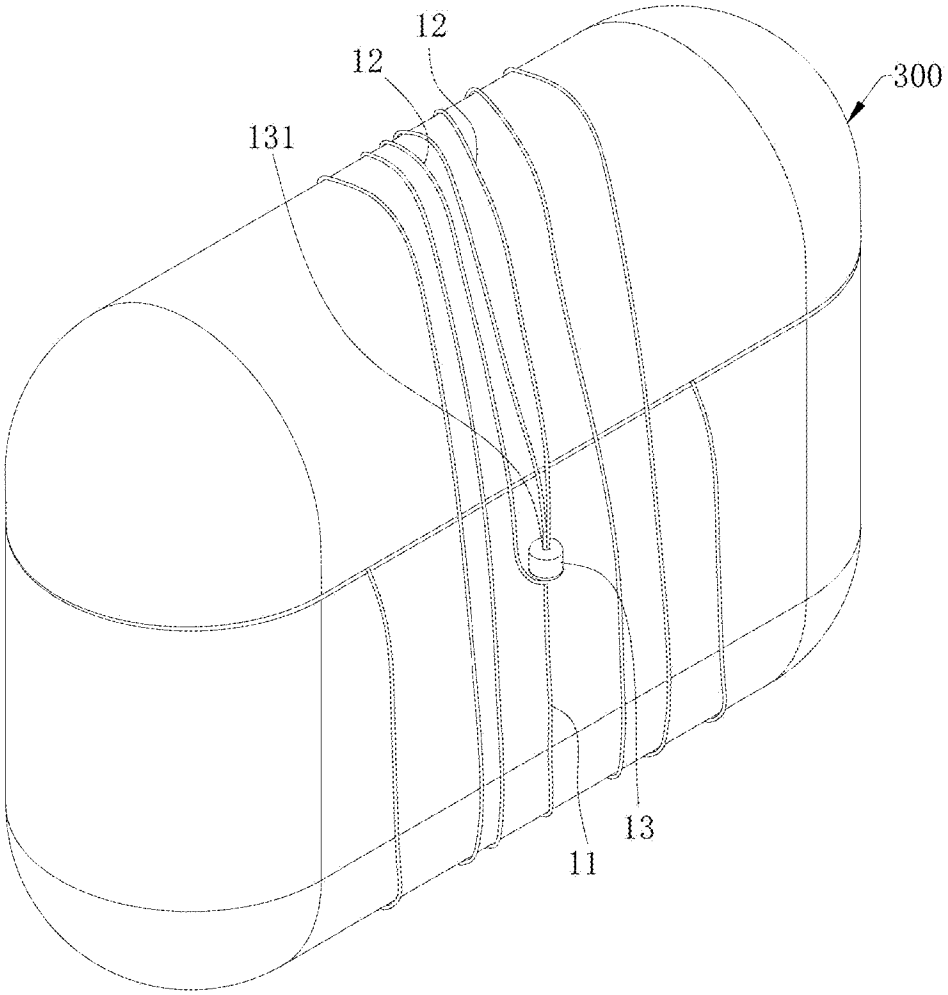
FIG. 3 is a perspective view of the anti-loss rope wrapped around the outside of the storage box and wrapped around the storage box in one direction in the anti-loss device of FIG. 2.
Figure 4:
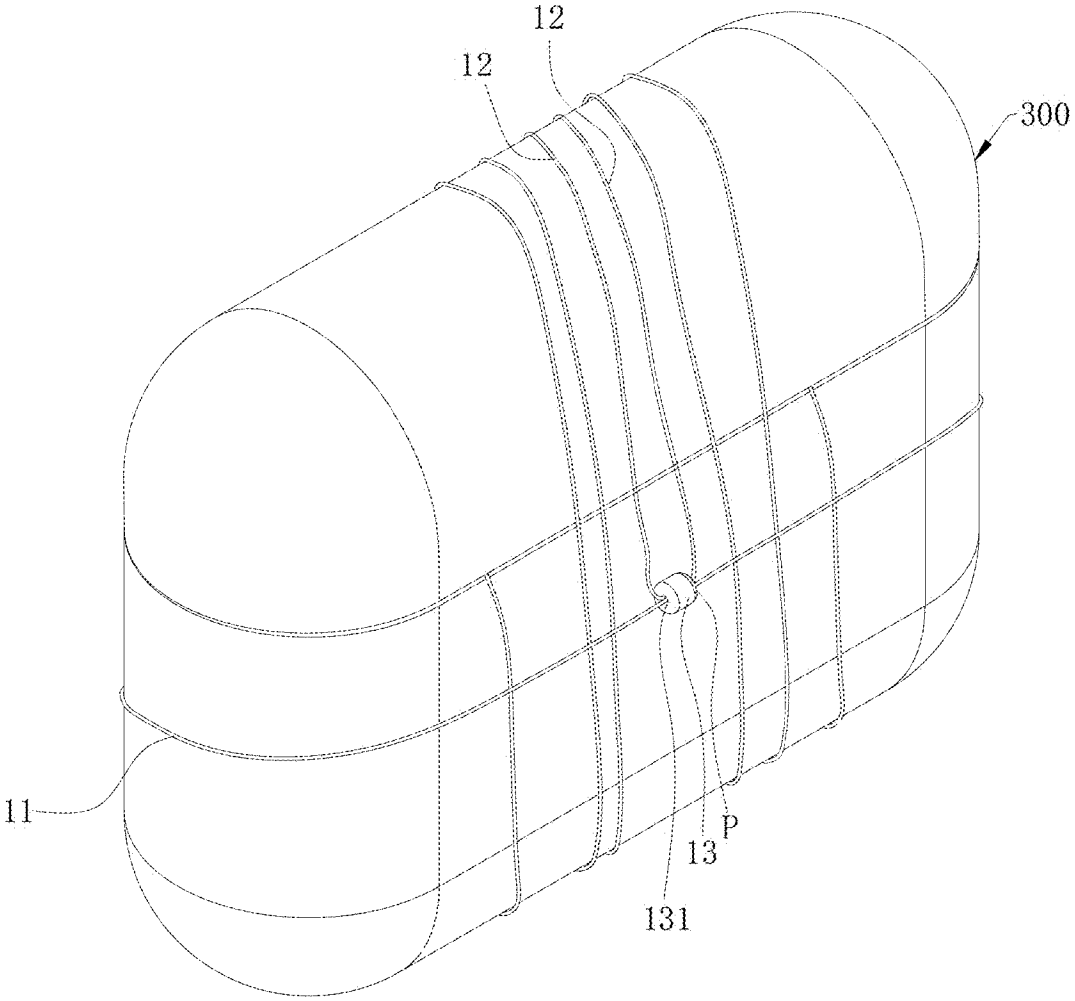
FIG. 4 is a perspective view of the anti-loss rope wrapped around the outside of the storage box and wrapped around the storage box in another direction in the anti-loss device of FIG. 2.

As shown in FIG. 1 to FIG. 3, the anti-loss rope 100 includes a rope assembly 1 and two connecting mechanisms 2 respectively connected to the rope assembly 1. The rope assembly 1 includes a holding loop 11, a joint part P, and two connecting sections 12. The joint part P is located between the holding loop 11 and the connecting sections 12. Each of the connecting mechanisms 2 is used for connecting a wireless in-ear audio device 200. The connecting sections 12 can be wound around the outside of the storage box 300, and the holding loop 11 is used for wrapping around the outside of the storage box 300 to prevent the rope assembly 1 from scattering.

As shown in FIG. 1 to FIG. 3, when the two connecting mechanisms 2 are completely connected to a pair of wireless in-ear audio devices 200, the pair of wireless in-ear audio devices 200 are placed in the earphone compartment of the storage box 300. The cover of the storage box 300 is closed over the earphone compartment to complete the storage of the wireless in-ear audio devices 200. The end of each connecting section 12 away from the joint part P is partially stored in the storage box 300, and the parts of the two connecting sections 12 protruding from the storage box 300 wrap around the outside of the storage box 300 in the same direction. The holding loop 11 wraps the outside of the storage box 300 in the same direction as the connecting sections 12, or it wraps around the outside of the storage box 300 perpendicularly to the connecting sections 12 (refer to FIG. 4).

FIG. 5 to FIG. 13 present the anti-loss rope 100 of the anti-loss device in the first embodiment of the present invention.

Figure 5:
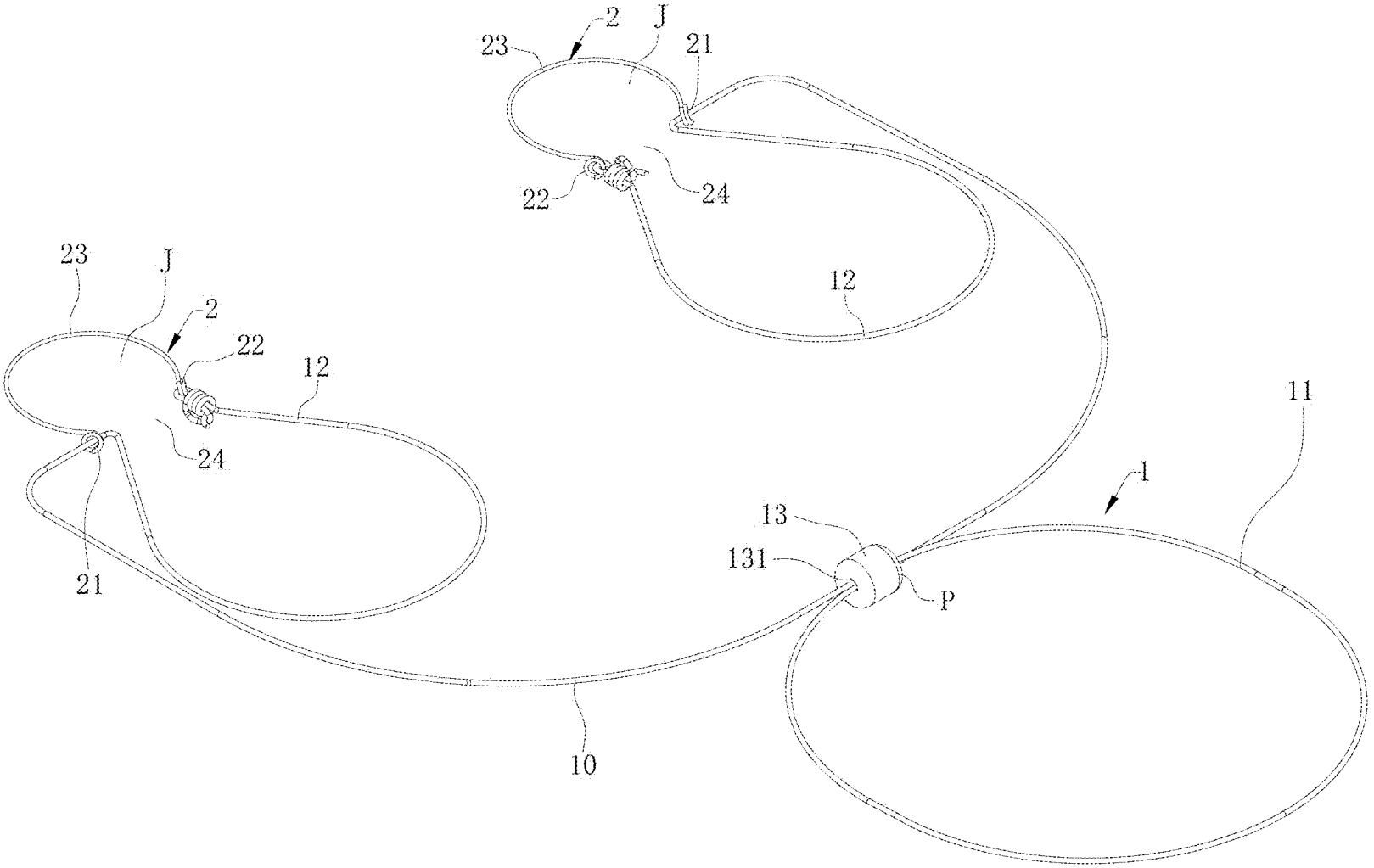
FIG. 5 is a perspective view of the anti-loss rope in the anti-loss device according to the first embodiment of the present invention.
Figure 6:
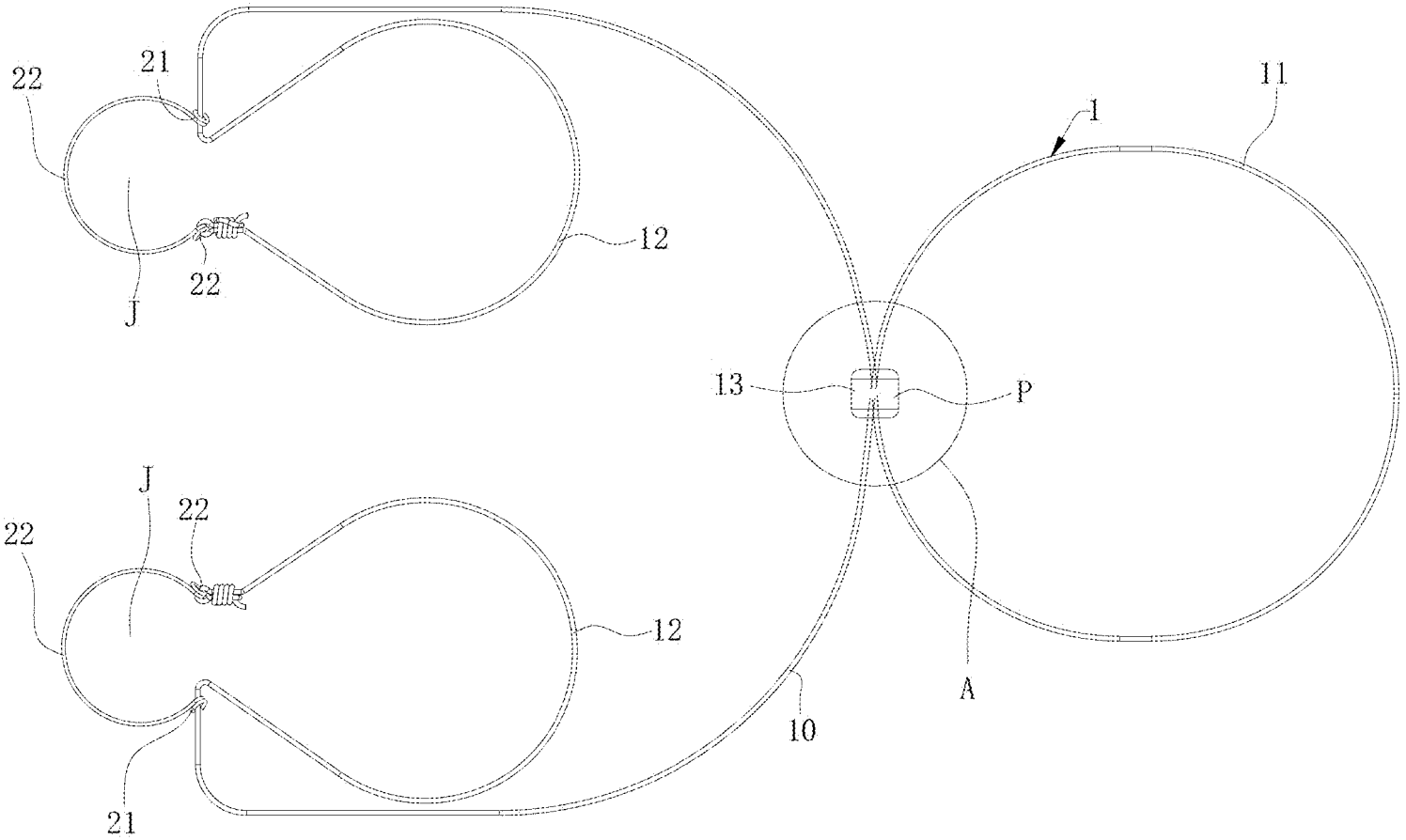
FIG. 6 is a top view of FIG. 5.
Figure 7:
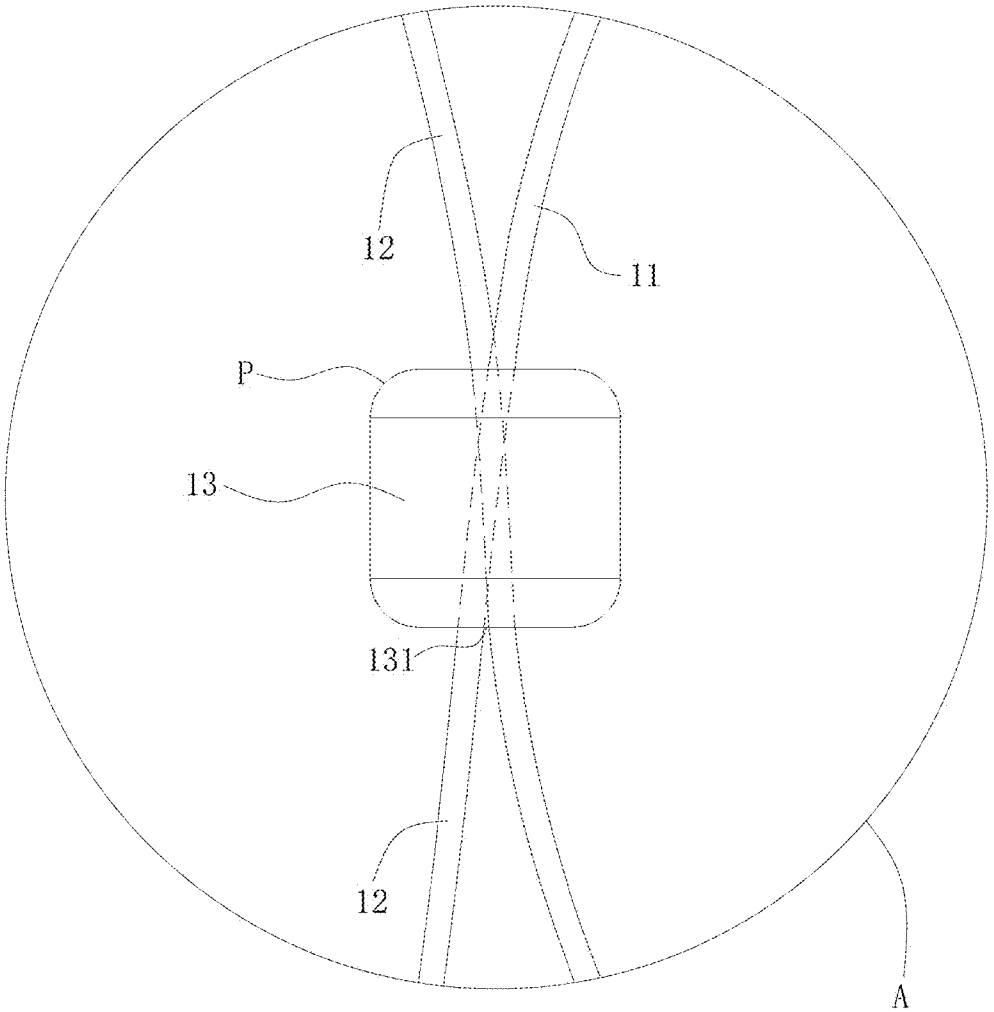
FIG. 7 is a partial enlarged view of A in FIG. 6.

As shown in FIG. 5 to FIG. 7, the rope assembly 1 includes a rope 10 with two free ends and an adjustment unit 13. The joint part P makes the rope 10 form the holding loop 11 and the connecting section 12. The rope 10 is an elastic rope, the adjustment unit 13 is a bead with a columnar structure, and the adjustment unit 13 includes a through hole 131. The rope 10 passes through the through hole 131 twice, allowing the rope 10 to wrap around the adjustment unit 13 once to form the holding loop 11. At the adjustment unit 13, the rope 10 forms the joint part P together with the adjustment unit 13, and the rope 10 forms two connecting sections 12 on two sides of the adjustment unit 13, which means that the two free ends of the rope 10 pass through the through hole 131 from two opposite sides, and the portions of the rope 10 emerging from the through hole 131 form the connecting sections 12. The two connecting sections 12 are respectively located on two sides of the through hole 131 to prevent the adjustment unit 13 from detaching easily from the rope 10. There are various embodiments for the joint part P in the present invention, and the embodiment described in this paragraph is just one of the embodiments of the joint part P in the anti-loss rope 100 of the present invention.

As shown in FIG. 6 and FIG. 7, the rope 10 is movably connected to the adjustment unit 13 in the through hole 131. The size of the holding loop 11 can be adjusted by moving the adjustment unit 13 along the rope 10 to accommodate storage boxes 300 of different sizes (refer to FIG. 3). Specifically, by pulling or loosening the connecting section 12 or the holding loop 11, the size of the holding loop 11 can be adjusted. In other embodiments, the adjustment unit 13 can also be fixedly attached to the rope 10 through a riveting or an adhesive method, whereby the position of the joint part P remains stable, and the size of the holding loop 11 is adjusted by the elastic variation of the elastic rope to accommodate storage boxes 300 of different sizes.

Figure 8:
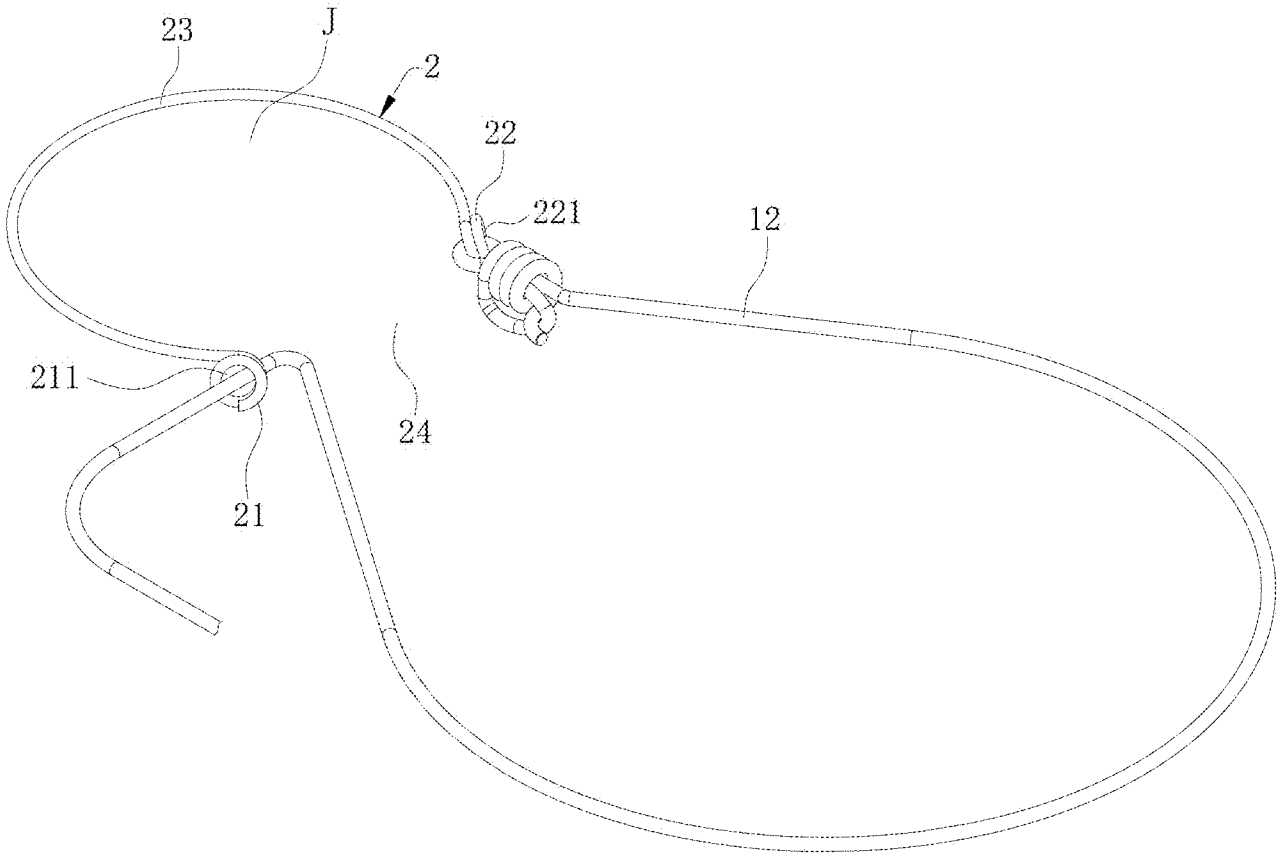
FIG. 8 is a partial perspective view of the connecting mechanism highlighting the anti-loss rope in FIG. 5.

As shown in FIG. 5 and FIG. 8, the connecting mechanism 2 is a circlip, and the circlip is formed by bending a metal wire integrally. The optimal cross-section of the metal wire is circular, but it is not limited to being circular, for it can be in other shapes, such as rectangular. The connecting mechanism 2 includes a first junction part 21, a second junction part 22, and a holding ring 23 connected to the first junction part 21 and the second junction part 22. The holding ring 23 is bent into a C-shape from the metal wire, and the holding ring 23 forms a accommodating space J on its inner side. The first junction part 21 and the second junction part 22 are spaced to form the opening 24, and the opening 24 links to the accommodating space J. The first junction part 21 has a first hole 211, and the second junction part 22 has a second hole 221. The connecting section 12 passes through the first hole 211 and the second hole 221 and is knotted to connect to the second junction part 22, allowing the connecting section 12 to connect to the second junction part 22; in other embodiment, the connecting section 12 passes through the first hole 211 and the second hole 221, and the connecting section 12 is connected to the second junction part 22 via tying a knot with itself. The connecting section 12 can move through the first hole 211, and the length of the connecting section 12 between the first hole 211 and the second hole 221 can be freely adjusted by pulling the connecting section 12. The opening 24 is used for allowing the wireless in-ear audio device 200 to pass through and be fastened to the accommodating space J. In other embodiments, the connecting section 12 can be connected to the second junction part 22 in other ways.

FIG. 9 to FIG. 13 present the schematic structural diagrams of the wireless in-ear audio device 200 in the anti-loss device of the present invention.

Figure 9:
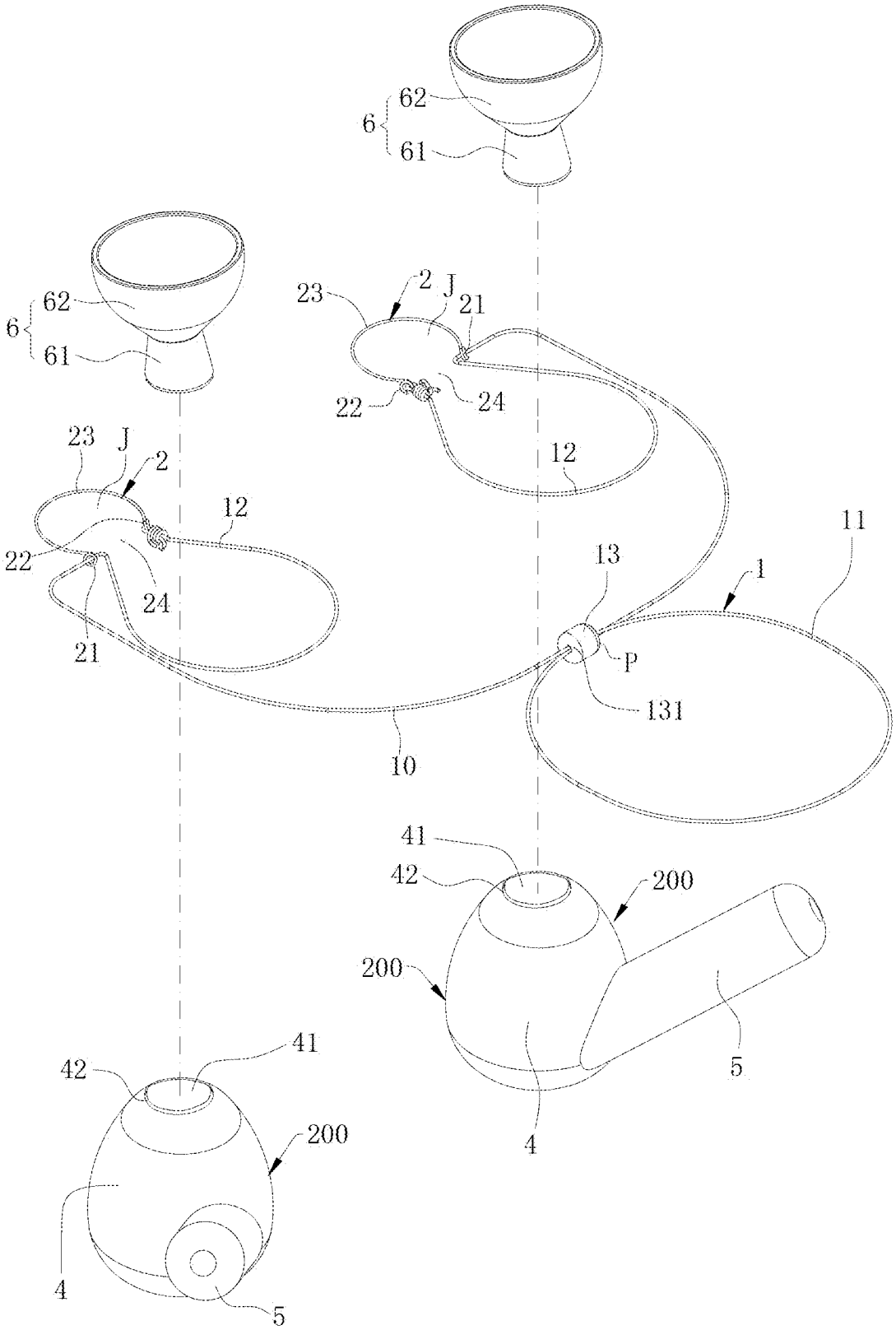
FIG. 9 is a three-dimensional exploded view of the anti-loss rope before connecting to the wireless in-ear audio device in FIG. 5.
Figure 10:
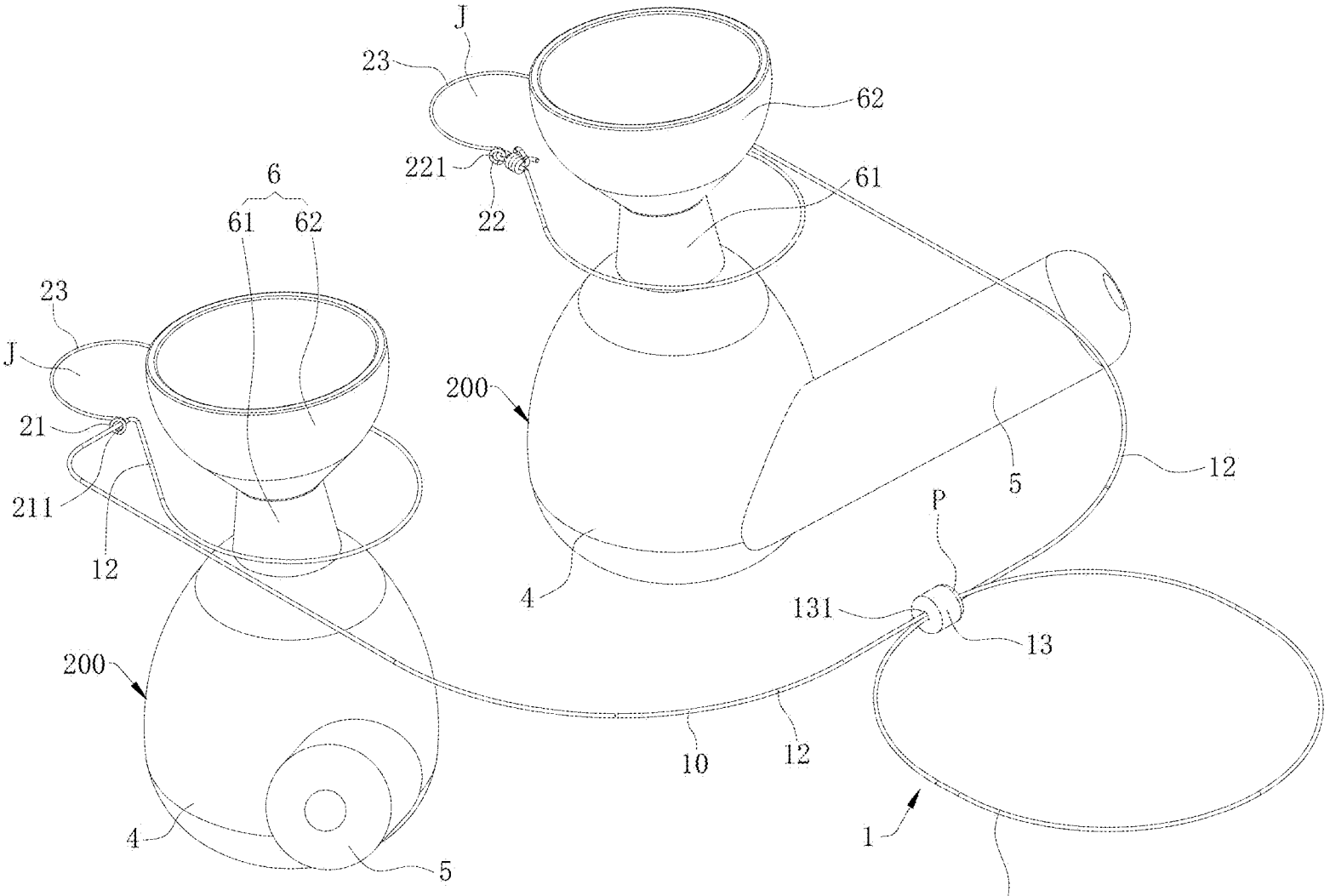
FIG. 10 is a perspective view of the wireless in-ear audio device when the anti-loss rope is loosely combined with the ear caps, which are assembled completely and flipped up in FIG. 9.

As shown in FIG. 9 and FIG. 10, the wireless in-ear audio device 200 includes a head 4, a rod 5, and an ear cap 6 fitted onto the head 4 and stably fastened to the head 4 along a fastening direction. The head 4 is integrally connected to the rod 5, and the head 4 includes an earpiece 41 and a fastening slot 42 surrounding the earpiece 41. The ear cap 6 includes a fastening convex part 61 and a flexible ear cover 62 connected to the fastening convex part 61. The ear cap 6 is structurally molded from silicone material. The fastening convex part 61 is fastened to the fastening slot 42 to fix the ear cap 6 to the head 4, and the flexible ear cover 62 covers the outside of the fastening convex part 61.

Figure 11:
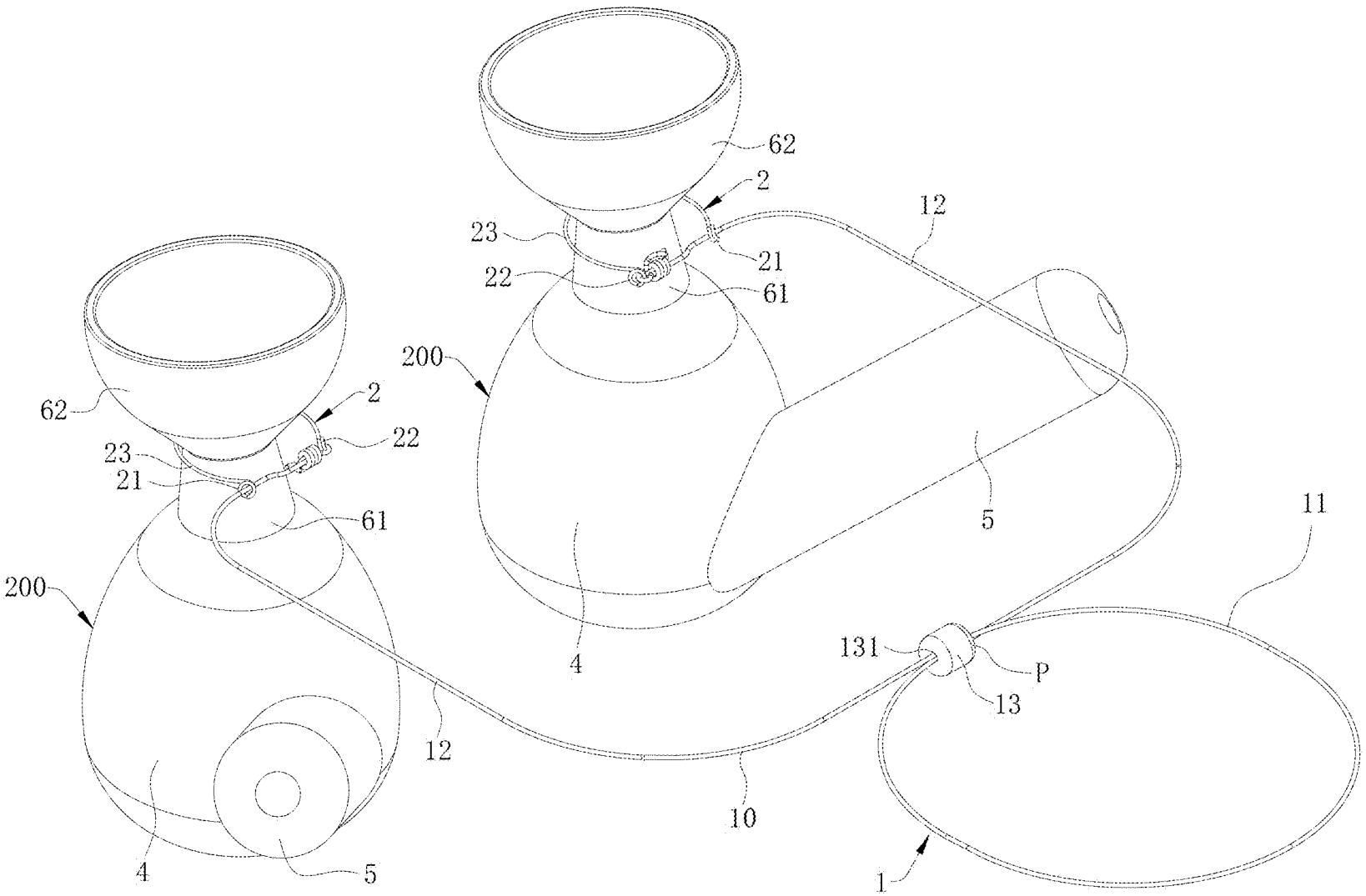
FIG. 11 is a perspective view of adjusting the anti-loss rope to snugly combine it with the wireless in-ear audio device in FIG. 10.
Figure 12:
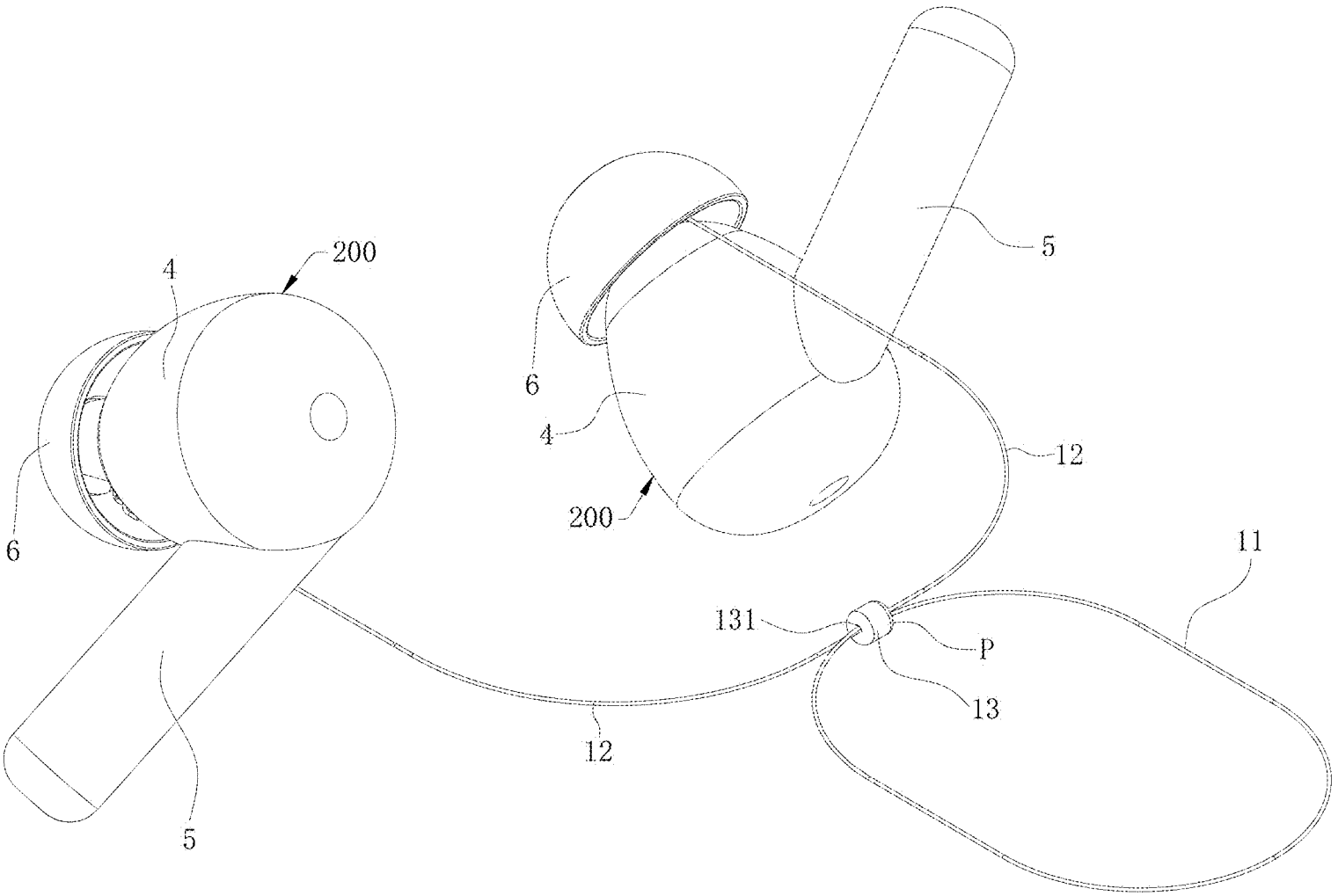
FIG. 12 is a perspective view of the wireless in-ear audio device when the ear caps are flipped back and fully connected to the anti-loss rope in FIG. 11.
Figure 13:
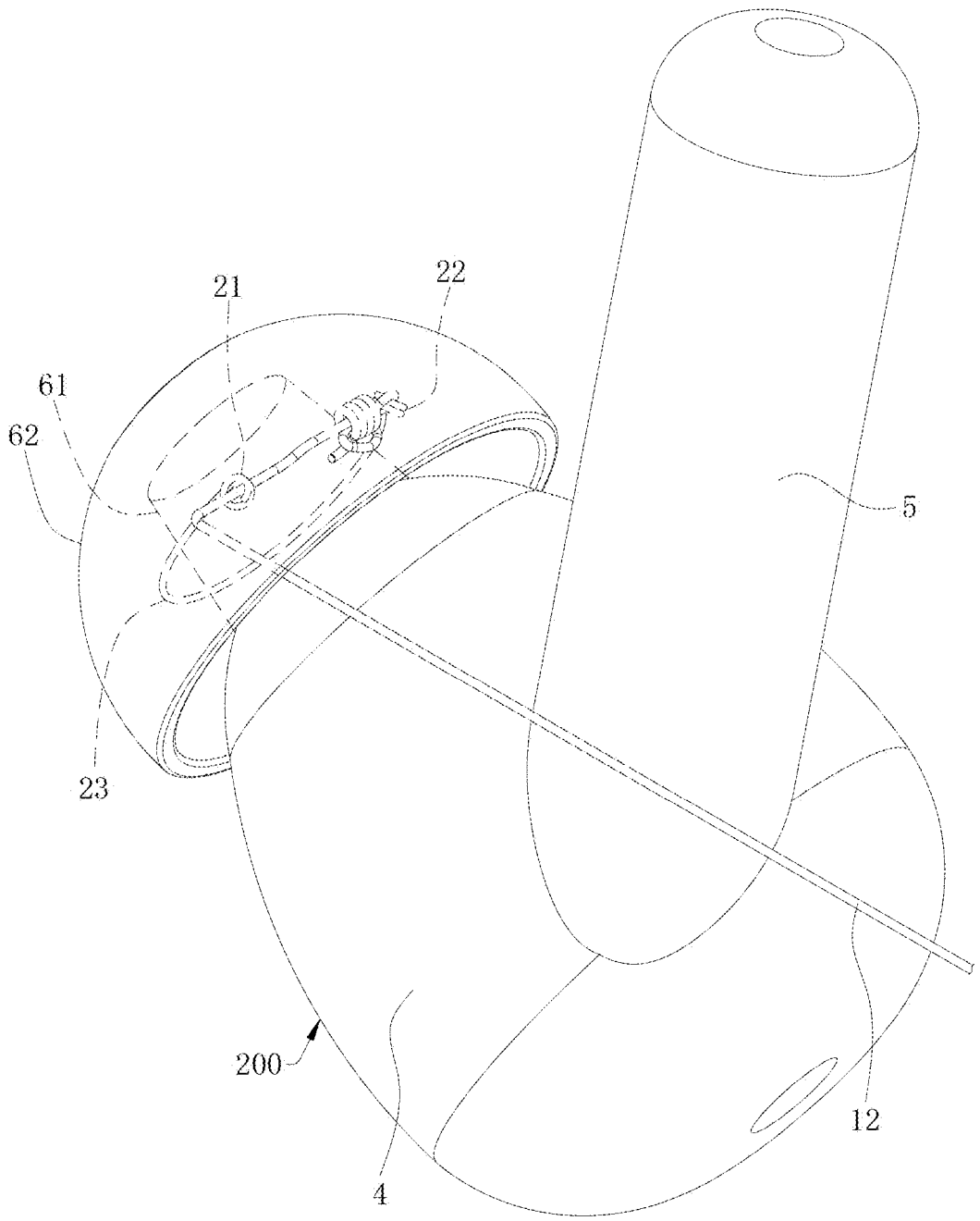
FIG. 13 is a perspective view of only one ear cap of the wireless in-ear audio device fully connected to the connecting mechanism after being flipped back in FIG. 12.

As shown in FIG. 11 and FIG. 13, the connecting mechanism 2 and the connecting section 12 located between the first junction part 21 and the second junction part 22 are coiled around the outside of the fastening convex part 61.

As shown in FIG. 10 to FIG. 13, the steps of connecting the connecting mechanism 2 to the wireless in-ear audio device 200 are as follows: Adjusting the length of the connecting section 12 at the first hole 211 and the second hole 221 through the first hole 211, ensuring that the space formed between the connecting section 12 and the first junction part 21 and the second junction part 22 is larger than the maximum outer diameter of the flexible ear cover 62, flipping the flexible ear cover 62 outward and placing it in the space, moving the holding ring 23 or the flexible ear cover 62 such that the wireless in-ear audio device 200 passes through the opening 24 and is then fastened to the accommodating space J, and then tightening the connecting section 12 towards the joint part P, narrowing the opening 24, allowing the holding ring 23 and a portion of the connecting section 12 to hold around the fastening convex part 61 to be accommodated between the flexible ear cover 62 and the fastening convex part 61, thereby completing the installation. In other embodiments, the circlip can also be fastened to the rod 5 of the wireless in-ear audio device 200.

Figure 14:
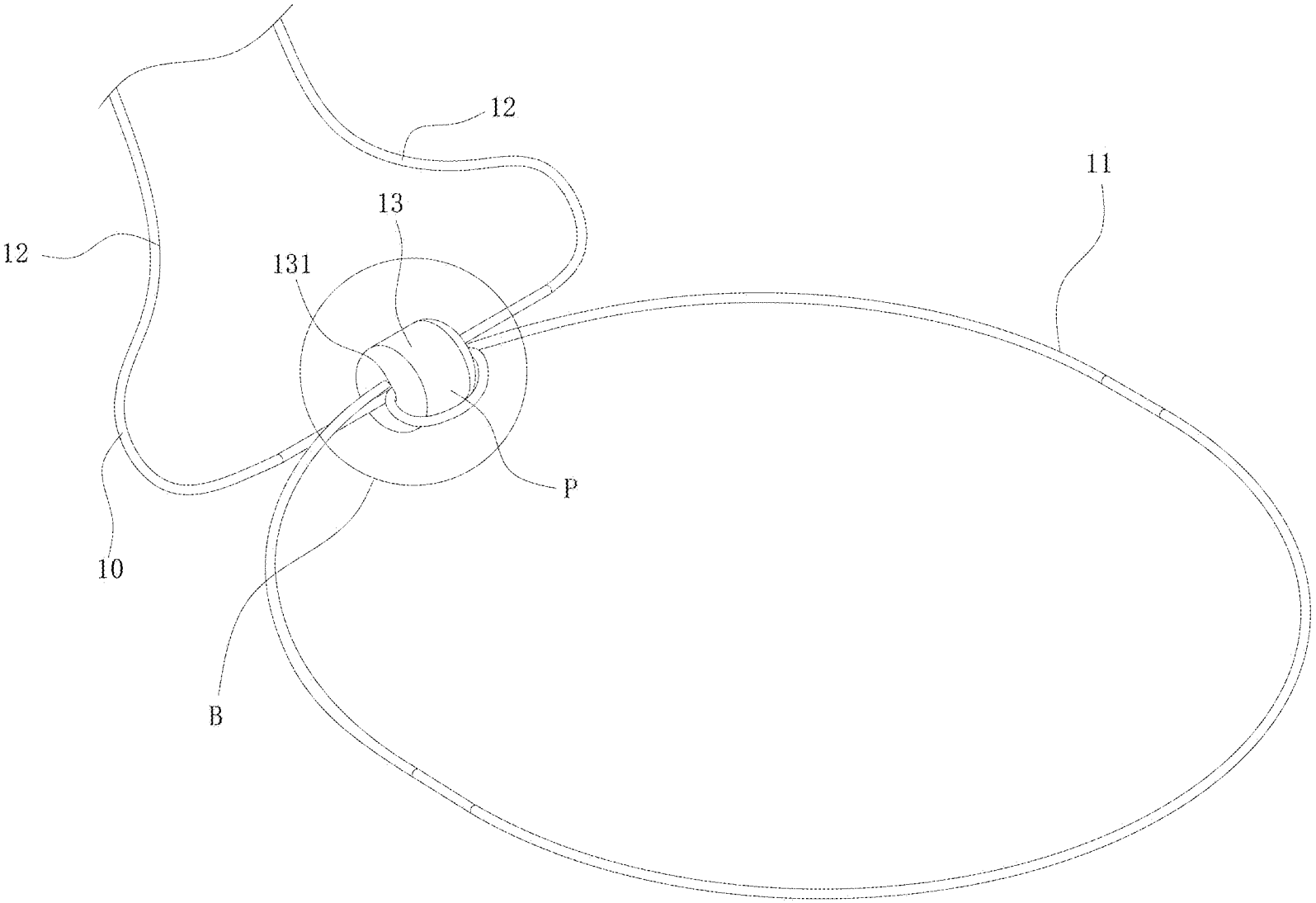
FIG. 14 is another embodiment of the joint part in the anti-loss rope of the present invention.
Figure 15:
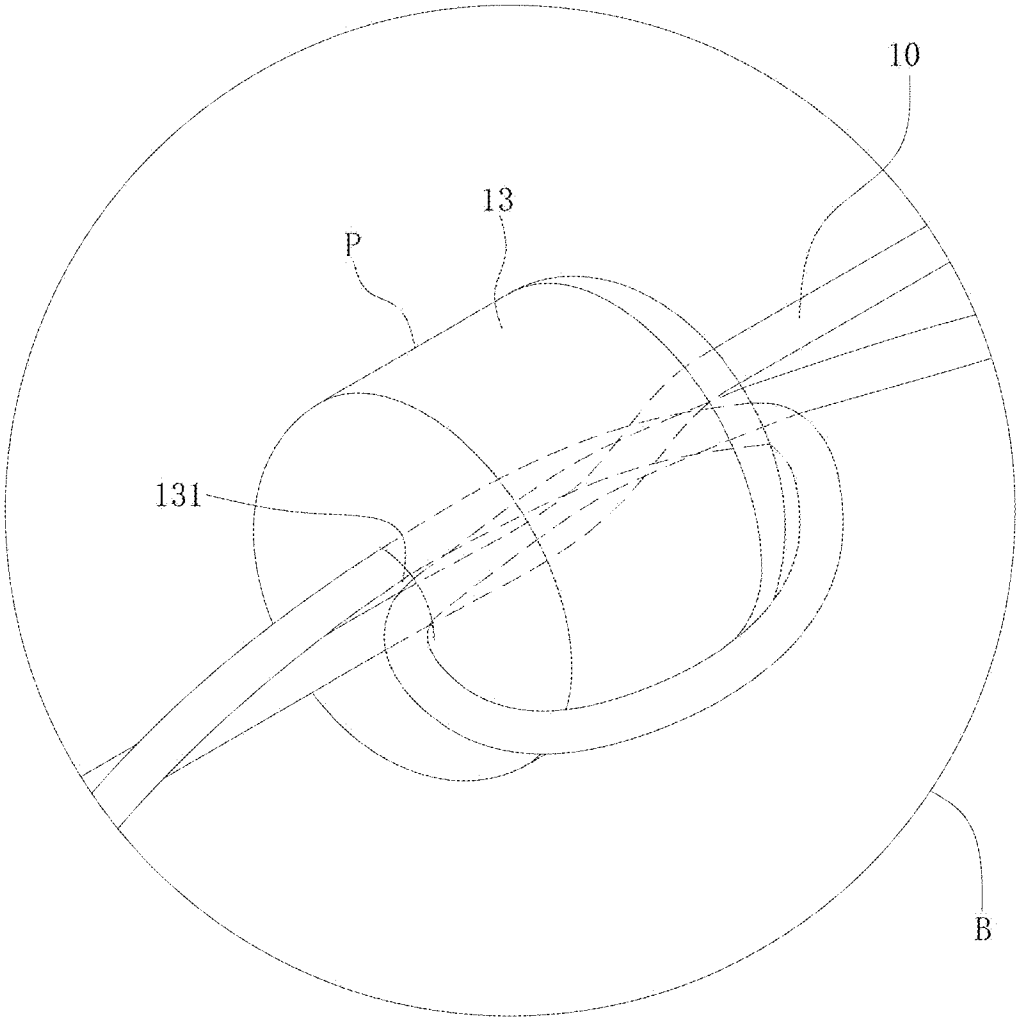
FIG. 15 is a partial enlarged view of B in FIG. 14.

FIG. 14 and FIG. 15 present another embodiment of the joint part P in the anti-loss rope 100 of the present invention. The structure of the joint part P of this embodiment can be applied to the previous embodiments of the anti-loss rope 100. In this embodiment, the rope 10 passes through the through hole 131 three times, allowing the rope 10 to loop around the adjustment unit 13 twice, wherein one coil forms the holding loop 11 and the other secures the adjustment unit 13. Specifically, the two free ends of the rope 10 pass through the through hole 131 from the two opposite sides, and one free end loops back along the same direction after the first passes through the through hole 131. In this way, pulling either one of the connecting sections 12 connected to the other free end and the holding loop 11 can adjust the size of the holding loop 11. Thus, when there is a significant size difference between the through hole 131 and the rope 10, increasing the friction between the rope 10 and the adjustment unit 13 can be achieved by coiling the rope 10 around the adjustment unit 13 twice to achieve the same effect without the need to replace the rope 10 with a rope 10 of another size or to replace the adjustment unit 13, thereby reducing the cost.

FIG. 16 to FIG. 19 present the anti-loss rope 100 of the anti-loss device in the second embodiment of the present invention.

Figure 16:
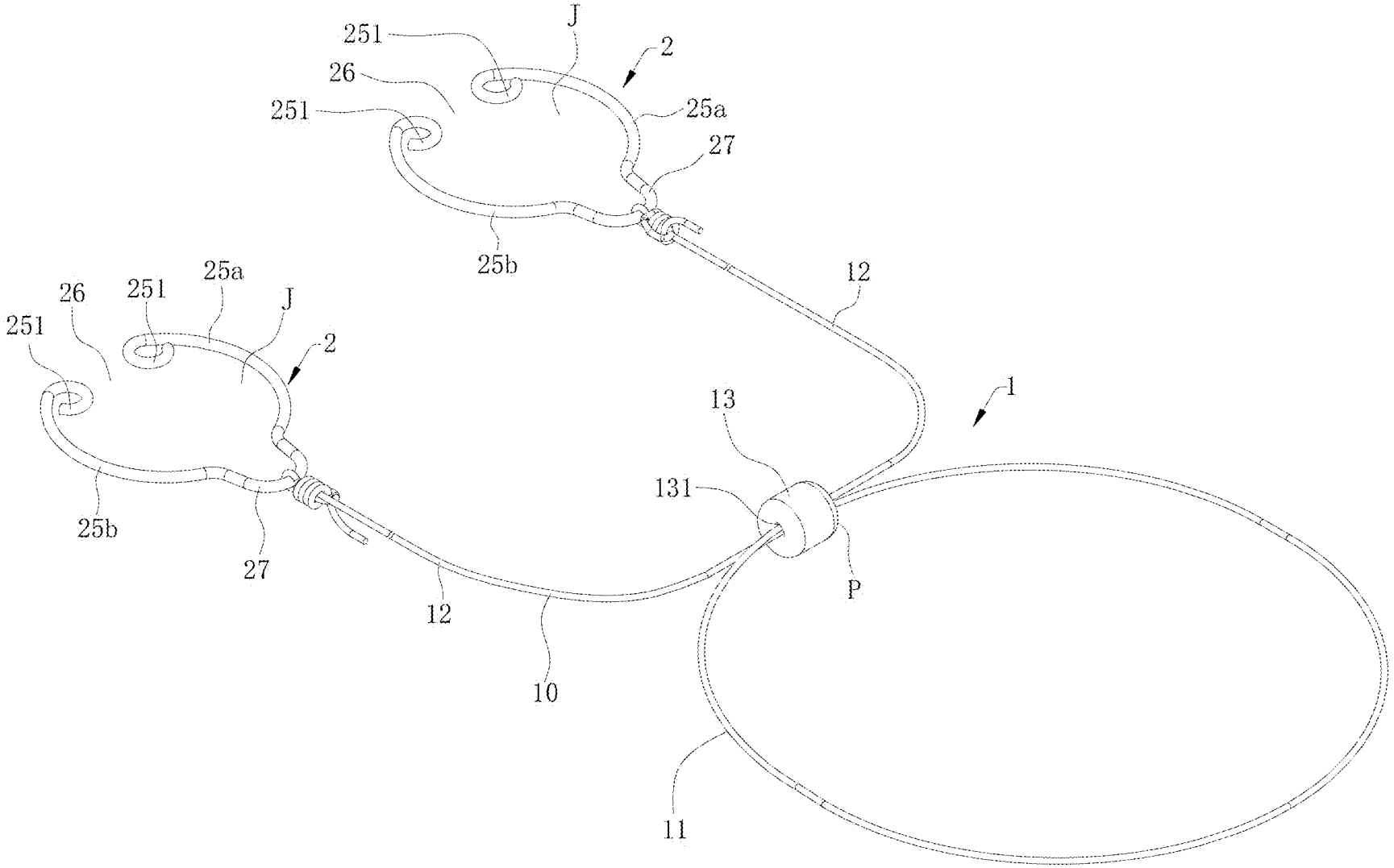
FIG. 16 is a perspective view of the anti-loss rope in the anti-loss device of the second embodiment of the present invention.
Figure 17:
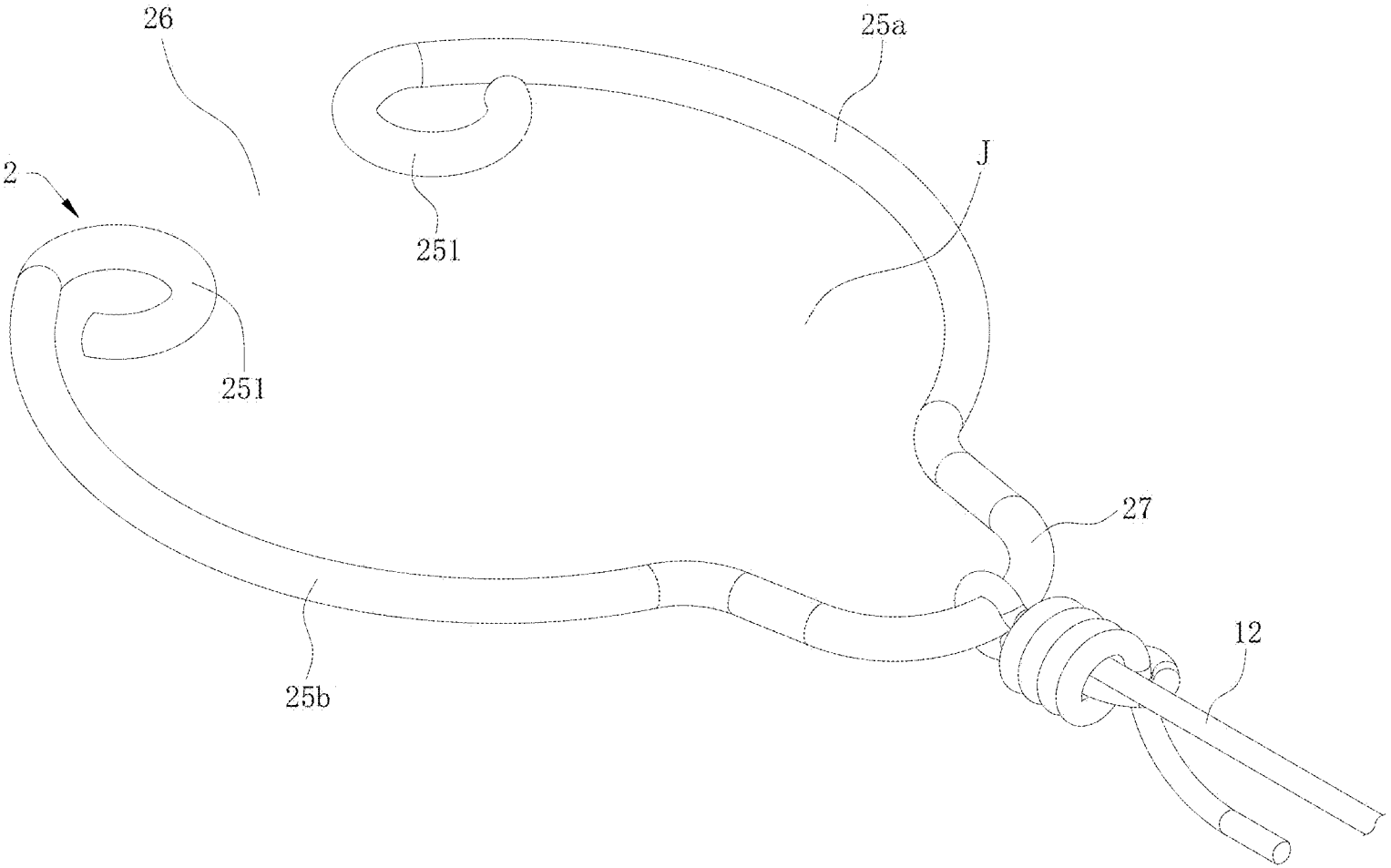
FIG. 17 is a partial perspective view of the connecting mechanism highlighting the anti-loss rope in FIG. 16.

As shown in FIG. 16 and FIG. 17, the rope assembly 1 includes a rope 10 with two free ends and an adjustment unit 13. The joint part P allows the rope 10 to form the holding loop 11 and the connecting section 12. The rope 10 is an elastic rope, and the adjustment unit 13 is a bead with a columnar structure. The adjustment unit 13 includes a through hole 131, and the rope 10 passes through the adjustment unit 13 twice, allowing the rope 10 to coil around the adjustment unit 13 once to form the holding loop 11. At the adjustment unit 13, the rope 10 forms the joint part P together with the adjustment unit 13. Two connecting sections 12 are formed on two sides of the adjustment unit 13, wherein the two free ends of the rope 10 pass through the through hole 131 from two opposite sides. The portions of the rope 10 protruding from the through hole 131 form the connecting sections 12, and the two connecting sections 12 are respectively positioned on two sides of the through hole 131 to prevent the adjustment unit 13 from detaching from the rope 10. That is, the joint part P described in this paragraph is the structure of the anti-loss rope 100 in the first embodiment. In other embodiments, the joint part P of the rope assembly 1 can also adopt another implementation of the joint part P of the present invention (refer to FIG. 14 and FIG. 15).

As shown in FIG. 16 and FIG. 17, the connecting mechanism 2 is a circlip, and each circlip is formed by bending a metal wire. The circlip includes a first arm 25*a* and a second arm 25*b* oppositely arranged to each other, a accommodating space J located between the first arm 25*a* and the second arm 25*b*, a notch 26 located on one side of the accommodating space J and linking to the accommodating space J, and a rope connecting part 27 located on the other side of the accommodating space J. One end of the first arm 25*a* and one end of the second arm 25*b* are respectively connected to the rope connecting part 27. The rope connecting part 27 protrudes towards the side away from the notch 26 relative to the first arm 25*a* and the second arm 25*b*. The free end of the connecting section 12 is connected to the rope connecting part 27 via a method of knotting. The accommodating space J is used for containing the wireless in-ear audio device 200 (refer to FIG. 19).

Figure 18:
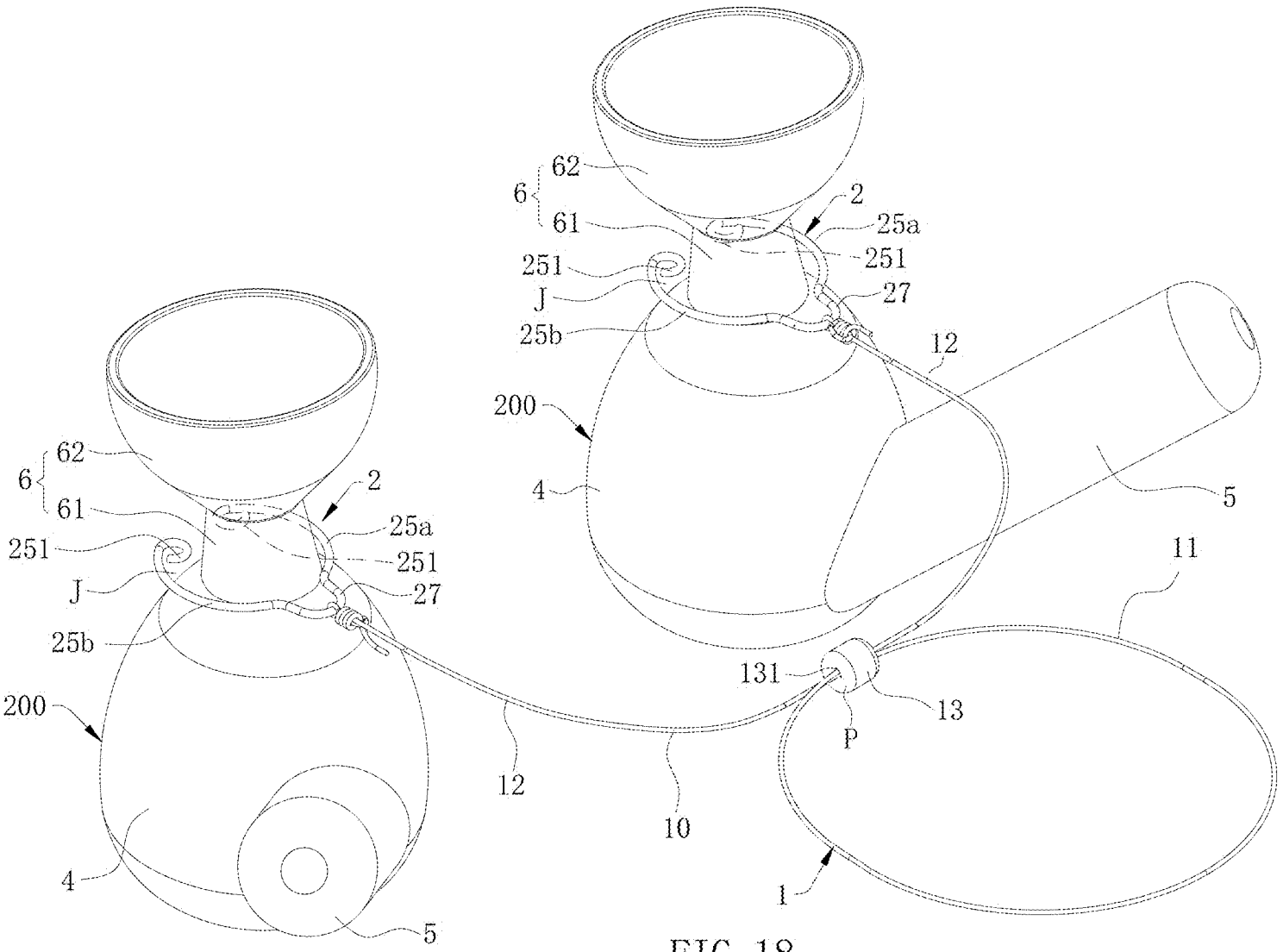
FIG. 18 is a perspective view of the wireless in-ear audio device when the connecting mechanism is loosely combined with the ear cap, which is flipped up in FIG. 16.

As shown in FIG. 17 and FIG. 18, the first arm 25*a* and the second arm 25*b* respectively include a guiding structure 251 on two sides of the notch 26. The guiding structure 251 of the first arm 25*a* bends and extends inwardly from one end of the first arm 25*a* away from the rope connecting part 27, and the guiding structure 251 of the second arm 25*b* bends and extends inwardly from one end of the second arm 25*b* away from the rope connecting part 27. The two guiding structures 251 are positioned opposite to each other and spaced apart. The notch 26 is located between the two guiding structures 251 and is used for facilitating elastic deformation of the circlip when the circlip is connected to the wireless in-ear audio device 200. Specifically, the notch 26 is provided for the wireless in-ear audio device 200 to pass through. The maximum size of the notch 26 is smaller than the minimum outer diameter of the part of the wireless in-ear audio device 200 passing through the notch 26. When the wireless in-ear audio device 200 passes through the notch 26, the two free ends of the circlip can contact the wireless in-ear audio device 200 and elastically deform under force and open to both sides.

Figure 19:
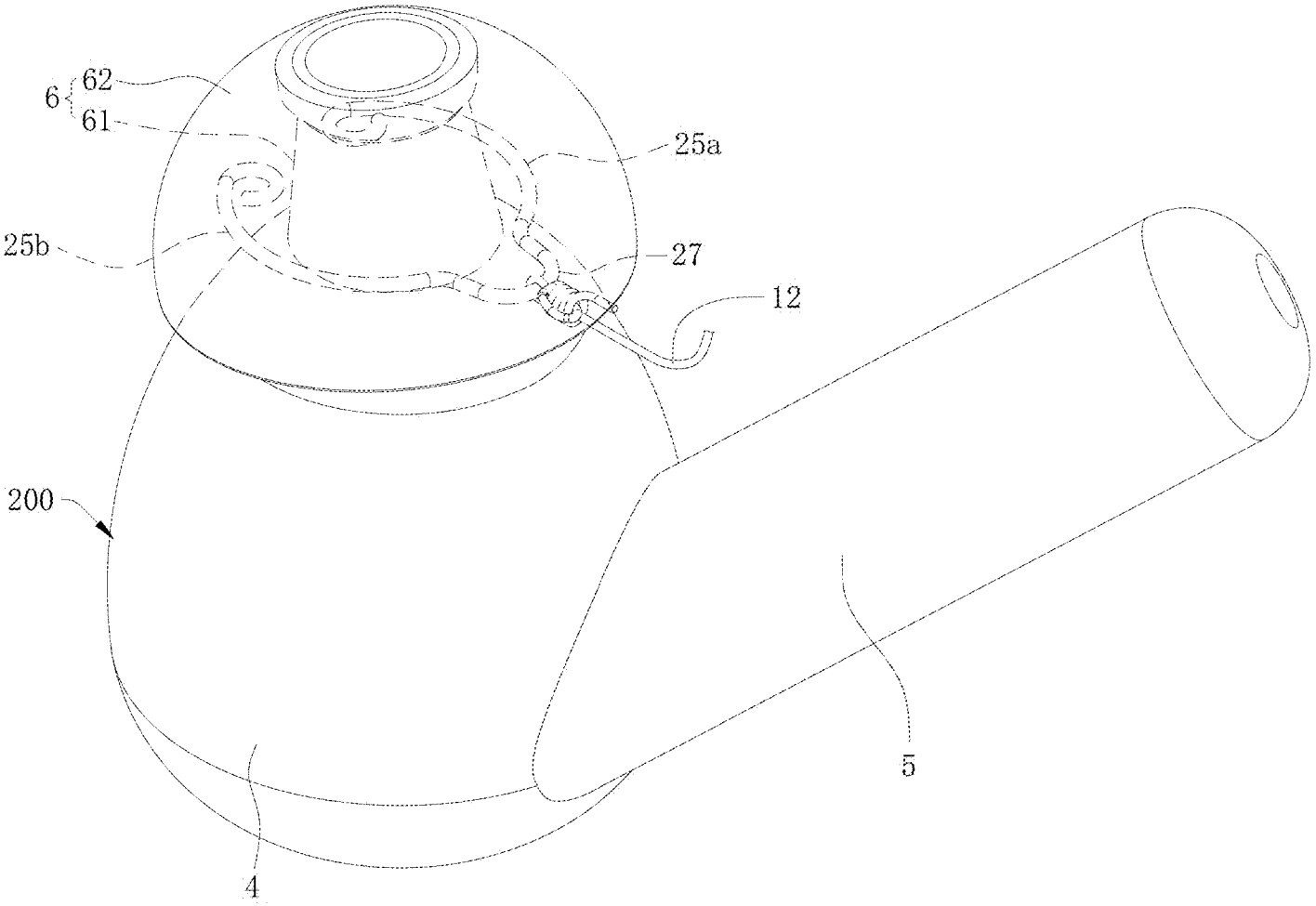
FIG. 19 is a partial perspective view of the wireless in-ear audio device fully connected to the connecting mechanism after the ear cap in FIG. 18 is flipped back.

As shown in FIG. 18 and FIG. 19, the steps for connecting the connecting mechanism 2 to the wireless in-ear audio device 200 of the anti-loss device of the present invention are as follows: Moving the wireless in-ear audio device 200 or the circlip such that the wireless in-ear audio device 200 passes through the notch 26 and enters the accommodating space J. The accommodating space J accommodates the ear cap 6. The first arm 25*a* and the second arm 25*b* both wrap around the fastening convex part 61, allowing the circlip to be located between the flexible ear cover 62 and the fastening convex part 61. Thus, the connection between the connecting mechanism 2 and the wireless in-ear audio device 200 is completed. In other embodiments, the circlip can also be fastened to the rod 5 of the wireless in-ear audio device 200.

The anti-loss rope 100 of the second embodiment of the present invention and the anti-loss rope 100 of the first embodiment are both stored in the storage box 300 in the same method, so there is no need for further description.

The beneficial effects of the anti-loss rope and anti-loss device of the present invention are as follows:

1. The placement of the holding loop 11 on the rope assembly 1 to be wrapped around the outside of the storage box 300 facilitates the organization and storage of the rope assembly 1 within the storage box 300, preventing the rope assembly 1 from becoming disorganized due to improper storage and thereby avoiding the occurrence of knots in the rope assembly 1.

2. The use of an elastic rope to form the rope assembly 1 allows adjustment of the size of the holding loop 11 through the elastic variation of the elastic rope to accommodate storage boxes 300 of different sizes.

3. Via setting the adjustment unit 13, the rope 10 passes through the through hole 131 at least twice, allowing the rope 10 to wrap around the adjustment unit 13 at least once. One coil forms the holding loop 11, and the rope 10 at the adjustment unit 13 cooperates with the adjustment unit 13 to form the joint part P such that the size of the holding loop 11 can be adjusted by moving the adjustment unit 13 to different positions along the rope 10 to accommodate storage boxes 300 of different sizes.

4. The rope 10 passes through the through hole 131 three times, allowing the rope 10 to wrap around the adjustment unit 13 twice. The other wrap holds tightly the adjustment unit 13. When the diameter of the rope 10 is too small and there is a significant difference between it and the through hole 131 of the adjustment unit 13, resulting in insufficient friction between the rope 10 and the adjustment unit 13, wrapping the adjustment unit 13 twice and fastening it with the adjustment unit 13 via another coil can increase the friction between the rope 10 and the adjustment unit 13 to prevent the adjustment unit 13 from sliding easily.

5. Via setting the first junction part 21, the second junction part 22, and the holding ring 23 connected to the first junction part 21 and the second junction part 22 in the connecting mechanism 2, a accommodating space J is formed on the inner side of the holding ring 23. The first junction part 21 and the second junction part 22 are spaced to form the opening 24. The first junction part 21 includes the first hole 211, and the connecting section 12 can pass through the first hole 211 to connect to the second junction part 22 such that the connecting section 12 can move through the first hole 211. Pulling on the connecting section 12 adjusts the length of the connecting section 12 between the first hole 211 and the second hole 221 to form the space with the connecting section 12 between the first hole 211 and the second hole 221 for wrapping around the outside of the wireless in-ear audio device 200. The opening 24 is used for allowing the wireless in-ear audio device 200 to pass through and be fastened to the accommodating space J. The wireless in-ear audio device 200 is surrounded by the first junction part 21, the holding ring 23, the second junction part 22, and the connecting section 12 located between the first junction part 21 and the second junction part 22, ensuring that the wireless in-ear audio device 200 will not easy fall off.

6. Due to the placement of the flexible ear cover 62 over the outside of the fastening convex part 61, the connecting mechanism 2 wraps around the fastening convex part 61 and is located between the flexible ear cover 62 and the fastening convex part 61. Unlike setting the connecting mechanism 2 on the rod 5, this arrangement makes it less likely to scratch or damage the wireless in-ear audio device 200 and also prevents the anti-loss rope 100 from easily detaching from the wireless in-ear audio device 200.

The detailed description above is only for illustration of preferred embodiments of the present invention and does not limit the scope of the present invention's patent. Therefore, all equivalent technical changes derived from the application of the content of this specification and drawings are included within the scope of the patent of this invention.

What is claimed is:

1. An anti-loss rope, comprising: a rope assembly and at least one connecting mechanism, wherein the rope assembly comprises a joint part, a holding loop and at least one connecting section, the joint part is located between the holding loop and the connecting section, the connecting mechanism is located at an end of the connecting section away from the joint part, the connecting mechanism is used for connecting a wireless in-ear audio device, and the holding loop is used for wrapping around an outside of a storage box;

wherein the rope assembly comprises an adjustment unit and a rope with two free ends; the adjustment unit comprises a through hole; the rope passes through the through hole at least two times, allowing the rope to loop around the adjustment unit for at least one coil; one coil of the rope forms the holding loop, and the rope cooperates with the adjustment unit together to form the joint part at the adjustment unit; an amount of the at least one connecting section is two, and an amount of the at least one connecting mechanism is two; the rope comprises two of the connecting sections, and each of the connecting sections is corresponded and configured with one of the connecting mechanisms.

2. The anti-loss rope as claimed in claim 1, wherein the rope passes through the through hole three times, allowing the rope to loop around the adjustment unit twice, and the adjustment unit is tightened by another coil.

3. The anti-loss rope as claimed in claim 1, wherein the rope is an elastic rope.

4. The anti-loss rope as claimed in claim 1, wherein the connecting mechanism is a circlip, the circlip is formed by bending a metal wire, the circlip comprises a first arm and a second arm arranged relatively, a accommodating space is located between the first arm and the second arm, a notch is located on one side of the accommodating space and linked to the accommodating space, a rope connecting part is located on another side of the accommodating space, the notch is used for allowing the circlip to elastically deform when the circlip is connected to the wireless in-ear audio device, each of the first arm and the second arm comprises a guiding structure on two sides of the notch, the accommodating space is used for containing the wireless in-ear audio device, and the rope connecting part is connected to a free end of the connecting section.

5. An anti-loss rope, comprising: a rope assembly and at least one connecting mechanism, wherein the rope assembly comprises a joint part, a holding loop and at least one connecting section, the joint part is located between the holding loop and the connecting section, the connecting mechanism is located at an end of the connecting section away from the joint part, the connecting mechanism is used for connecting a wireless in-ear audio device, and the holding loop is used for wrapping around an outside of a storage box;

wherein the connecting mechanism comprises a first junction part, a second junction part and a holding ring which is connected to the first junction part and the second junction part, an inside of the holding ring forms a accommodating space, the first junction part and the second junction part are spaced apart to form an opening, the opening links to the accommodating space, the first junction part comprises a first hole, the connecting section passes through the first hole and links to the second junction part, and the opening is provided for the wireless in-ear audio device to pass through so as to be fastened to the accommodating space.

6. The anti-loss rope as claimed in claim 5, wherein the second junction part comprises a second hole, the connecting section passes through the second hole, and the connecting section is connected to the second junction part via a knotted method.

7. The anti-loss rope as claimed in claim 5, wherein the connecting mechanism is a circlip, and the circlip is formed by bending a metal wire in one piece.

8. An anti-loss device, comprising:

a storage box;

a pair of wireless in-ear audio devices, the wireless in-ear audio devices being stored in the storage box;

an anti-loss rope, comprising a rope assembly and two connecting mechanisms, wherein the rope assembly comprises a joint part, a holding loop and two connecting sections, the joint part is located between the holding loop and the connecting section, the connecting mechanism is located at an end of the connecting section away from the joint part, the connecting mechanism is connected to the wireless in-ear audio device, the connecting section wraps around an outside of the storage box, and the holding loop wraps around an outside of the storage box; wherein the rope assembly comprises an adjustment unit and a rope with two free ends; the adjustment unit comprises a through hole; the rope passes through the through hole at least two times, allowing the rope to loop around the adjustment unit for at least one coil; one coil of the rope forms the holding loop; the rope cooperates with the adjustment unit together to form the joint part at the adjustment unit; an amount of the at least one connecting section is two; and the rope forms two of the connecting sections on two sides of the adjustment unit.

9. The anti-loss device as claimed in claim 8, wherein the rope passes through the through hole three times, allowing the rope to loop around the adjustment unit twice, and the adjustment unit is tightened by another coil.

10. The anti-loss device as claimed in claim 8, wherein the rope is an elastic rope.

11. The anti-loss device as claimed in claim 8, wherein the two connecting sections exposed from the storage box wrap around in the same direction along the outside of the storage box, the holding loop wraps around the storage box in the same direction as the connecting section, or the holding loop wraps around the storage box perpendicularly to the connecting section and is sleeved on the storage box.

12. The anti-loss device as claimed in claim 8, wherein the wireless in-ear audio device comprises a head, a rod, and an ear cap which holds on the head and is stably connected to the head along a fastening direction; the head and the rod are connected integrally; the head comprises an earpiece and a fastening slot surrounding the earpiece; the ear cap comprises a fastening convex part and a flexible ear cover connected to the fastening convex part; the fastening convex part is fastened to the fastening slot, allowing the ear cap to be fixed on the head; the flexible ear cover covers an outside of the fastening convex part; and the connecting mechanism wraps the fastening convex part and is located between the flexible ear cover and the fastening convex part.

13. The anti-loss device as claimed in claim 12, wherein the connecting mechanism comprises a first junction part, a second junction part, and a holding ring connected to the first junction part and the second junction part; the holding ring forms a accommodating space inside; the first junction part and the second junction part are spaced to form an opening; the opening links to the accommodating space; the first junction part comprises a first hole; the connecting section passes through the first hole and is connected to the second junction part; and the opening is provided for the fastening convex part to pass through to be located in the accommodating space, allowing the holding ring to be located between the flexible ear cover and the fastening convex part.

14. The anti-loss device as claimed in claim 13, wherein the second junction part comprises a second hole, the connecting section passes through the second hole, and the connecting section is connected to the second junction part via a knotting method.

15. The anti-loss device as claimed in claim 13, wherein the connecting mechanism is a circlip, and the circlip is formed by bending a metal wire in one piece.

16. The anti-loss device as claimed in claim 8, wherein the connecting mechanism is a circlip, the circlip is formed by bending a metal wire, the circlip comprises a first arm and a second arm arranged relatively, a accommodating space is located between the first arm and the second arm, a notch is located on one side of the accommodating space and linked to the accommodating space, and a rope connecting part is located on another side of the accommodating space; the notch is used for allowing the circlip to elastically deform when the circlip is connected to the wireless in-ear audio device; each of the first arm and the second arm comprises a guiding structure on two sides of the notch; the accommodating space is used for containing the wireless in-ear audio device; and the rope connecting part is connected to a free end of the connecting section.

* * * * *